US007419253B2

(12) United States Patent
Olsen et al.

(10) Patent No.: US 7,419,253 B2
(45) Date of Patent: Sep. 2, 2008

(54) CHANNELING FLUID FLOW

(75) Inventors: David N. Olsen, Corvallis, OR (US); Gilbert G. Smith, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 406 days.

(21) Appl. No.: 11/062,223

(22) Filed: Feb. 18, 2005

(65) Prior Publication Data

US 2006/0187268 A1 Aug. 24, 2006

(51) Int. Cl.
*B41J 2/175* (2006.01)

(52) U.S. Cl. ..... 347/86; 347/92

(58) Field of Classification Search ..... 347/20, 347/56, 65, 92–94, 84–87, 67
See application file for complete search history.

(56) References Cited

U.S. PATENT DOCUMENTS 7,070,266 B2 * 7/2006 Ogawa et al. ..... 347/87

FOREIGN PATENT DOCUMENTS

JP 58-188668 * 4/1982 ..... 347/92
JP 3-272859 * 9/1990 ..... 347/92

* cited by examiner

*Primary Examiner*—Juanita D Stephens

(57) ABSTRACT

In one embodiment, a fluid flow channel includes a first part and a second part connected to and positioned downstream from the first part such that fluid can flow from the first part to the second part. The first part has opposing sidewalls, a floor extending between the sidewalls, and a ceiling extending between the sidewalls. The ceiling of the first part slopes upward in an upstream direction or the sidewalls taper in toward one another in a downstream direction, or both. The second part has opposing sidewalls and a ceiling extending between the sidewalls. The ceiling of the second part slopes upward in an upstream direction.

8 Claims, 10 Drawing Sheets

CHANNELING FLUID FLOW

BACKGROUND

Thermal inkjet printers utilize one or more printheads to deposit ink on paper and other print media. A printhead is a micro-electromechanical part that contains an array of miniature thermal resistors that are energized to eject small droplets of ink out of an associated array of orifices. Air and other gases may form in the ink moving through the printhead as the ink is heated and cooled. Gas bubbles allowed to accumulate near the printhead can eventually displace all of the ink at the printhead, causing the printhead to lose its prime and rendering the printhead useless. It is desirable, therefore, to move air and other gas bubbles away from the printhead.

DRAWINGS

Figure 14:
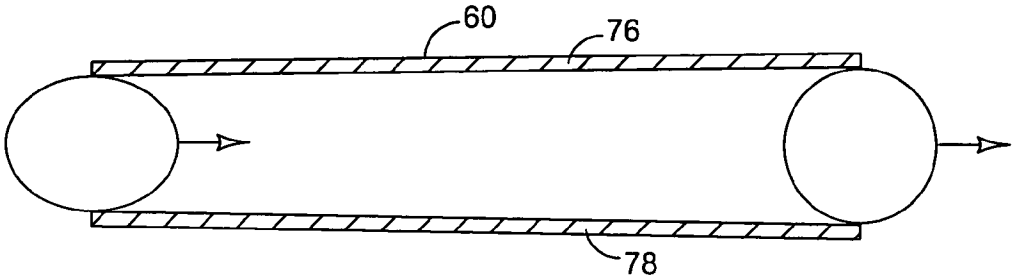
Figure 12:
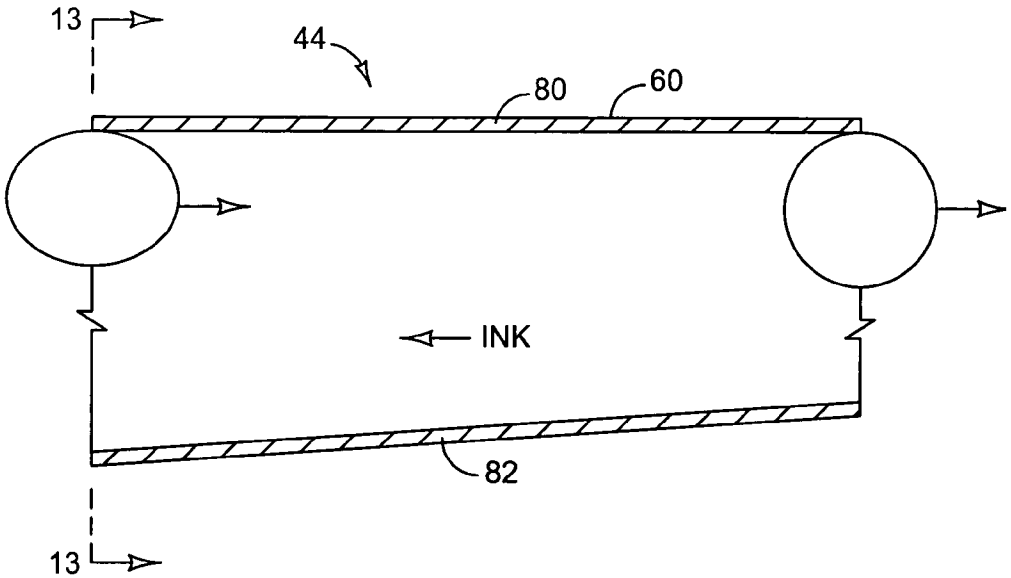
FIG. 12 is a section view taken along the line 12-12 in FIG. 7 illustrating the taper tunnel area in the middle part of the channel.
Figure 13:
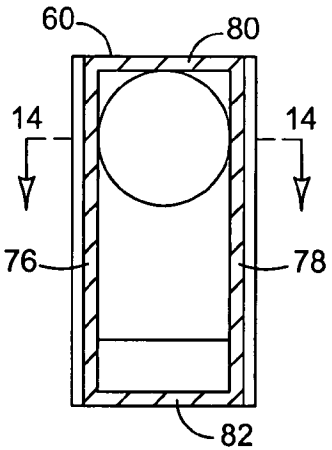

FIGS. 13 and 14 are section views taken along the lines 13-13 and 14-14 in FIGS. 12 and 13, respectively.

Figure 7:
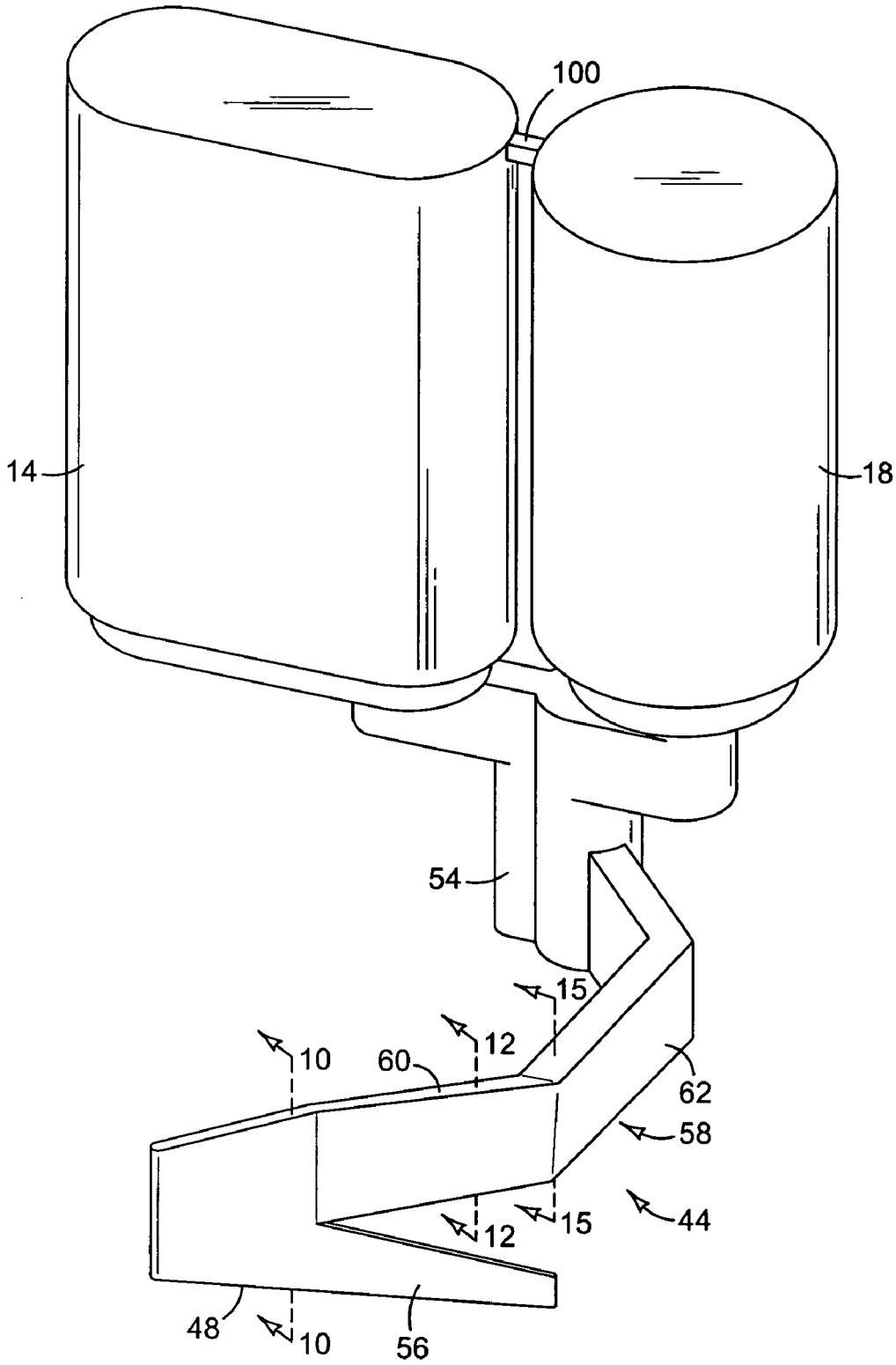
FIGS. 7 and 8 are perspective views of one embodiment of an ink chamber and flow channel in the cartridge of FIG. 1.
Figure 15:
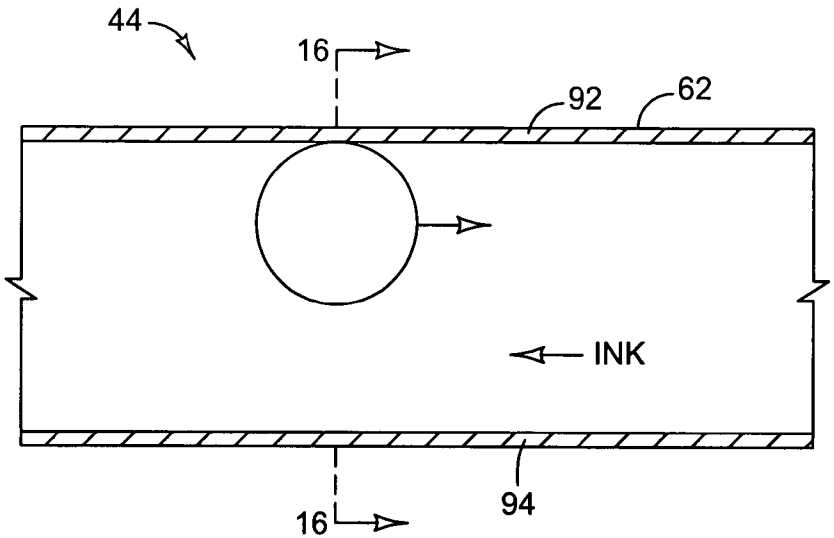

FIG. 15 is a section view taken along the line 15-15 in FIG. 7 illustrating the bubble tunnel area of the channel.

Figure 17:
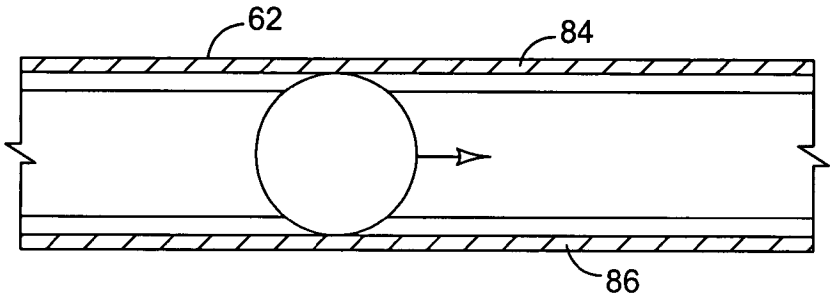
Figure 16:
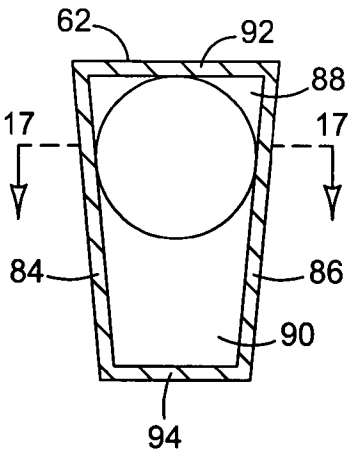

FIGS. 16 and 17 are section views taken along the lines 16-16 and 17-17 in FIGS. 15 and 16, respectively.

Figure 8:
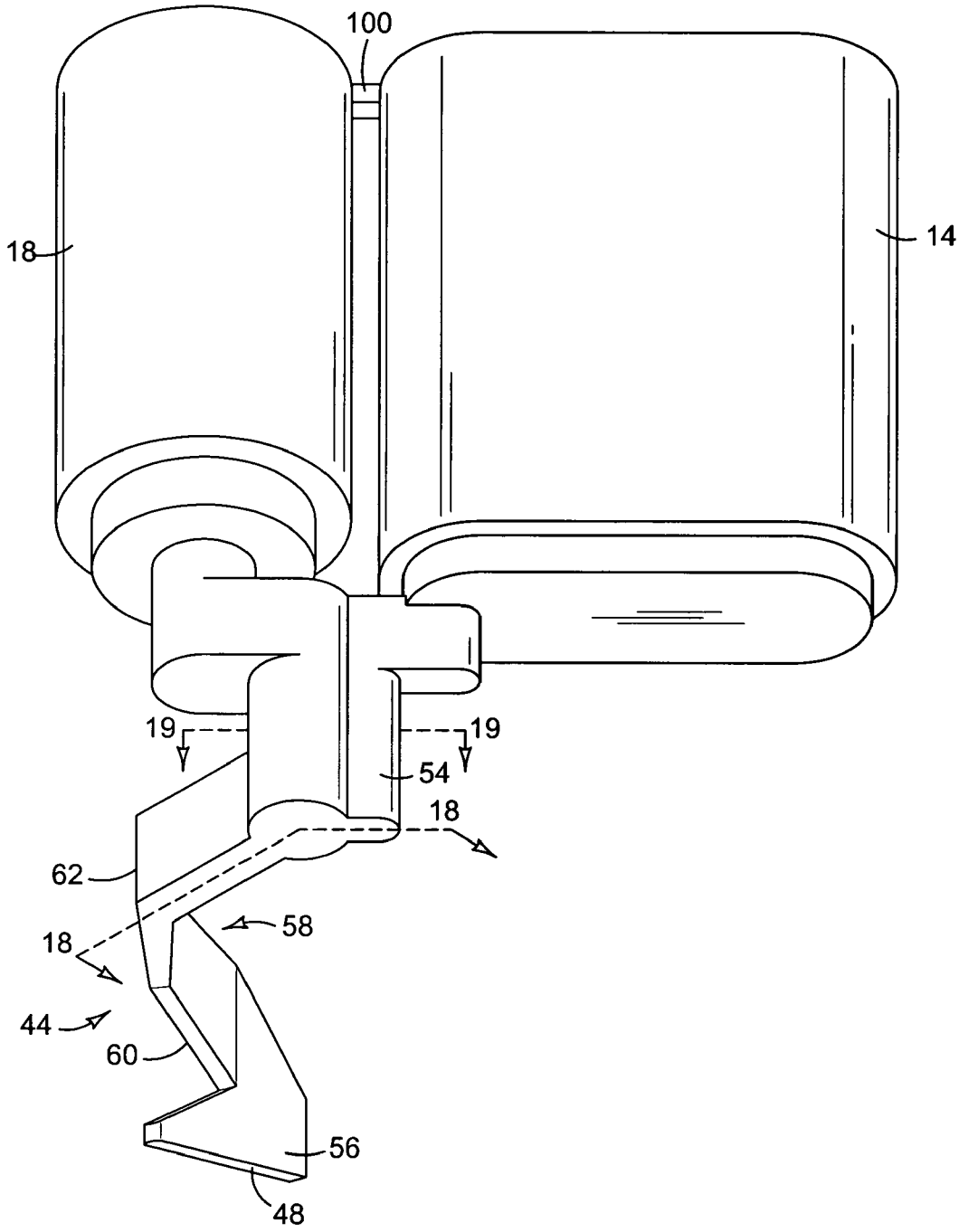
Figure 18:
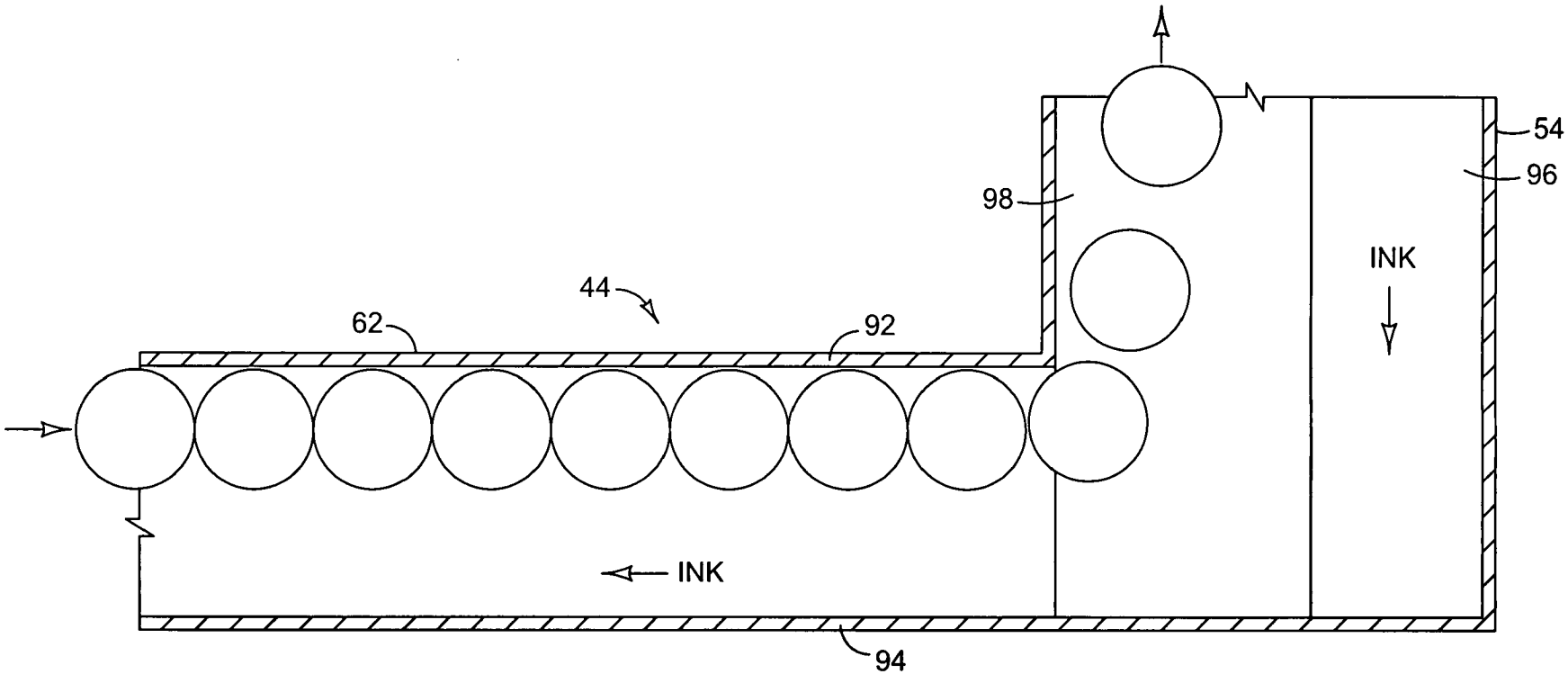
Figure 19:
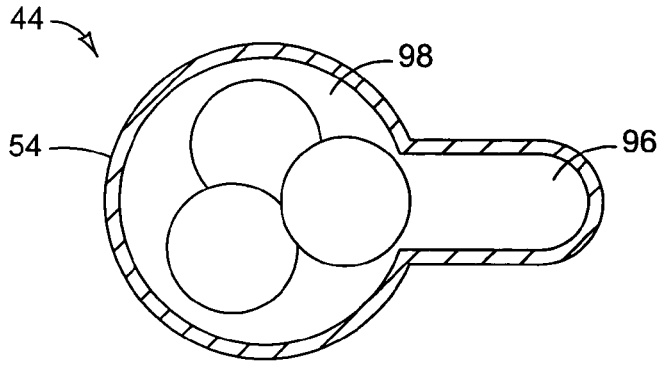

FIGS. 18 and 19 are section views taken along the lines 18-18 and 19-19 in FIG. 8 illustrating the bubble tunnel in the middle part of the channel and the upper part of the channel.

Figure 20:
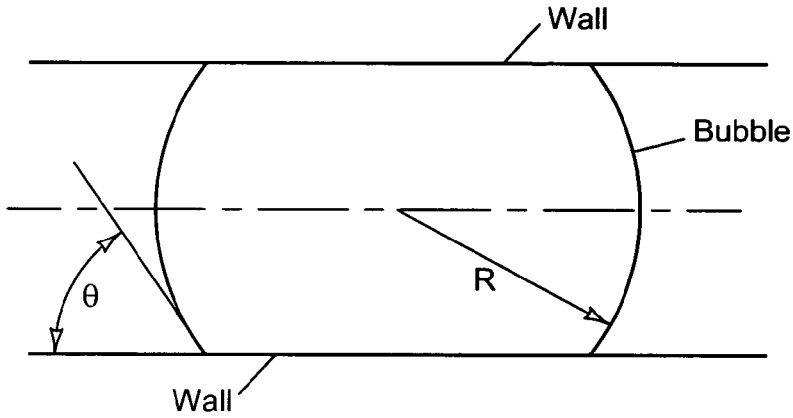

FIG. 20 is a diagram showing the geometry of a bubble in a channel with non-tapered walls.

Figure 21:
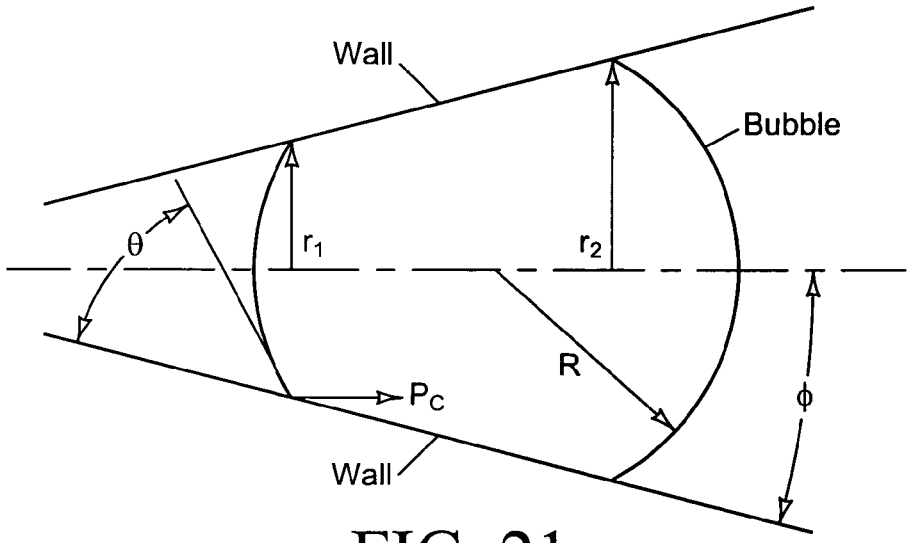

FIG. 21 is a diagram showing the geometry of a bubble in a channel with tapered walls.

DESCRIPTION

Embodiments of the present invention were developed in an effort to move gas bubbles away from the printhead in a print cartridge. A print cartridge is also commonly referred to as an ink pen, an ink cartridge or an inkjet print head assembly. Exemplary embodiments of the invention will be described, therefore, with reference to a print cartridge and inkjet printing. Embodiments of the invention, however, are not limited to print cartridges, inkjet printing or ink flow. Hence, the following description should not be construed to limit the scope of the invention, which is defined in the claims that follow the description.

Figure 2:
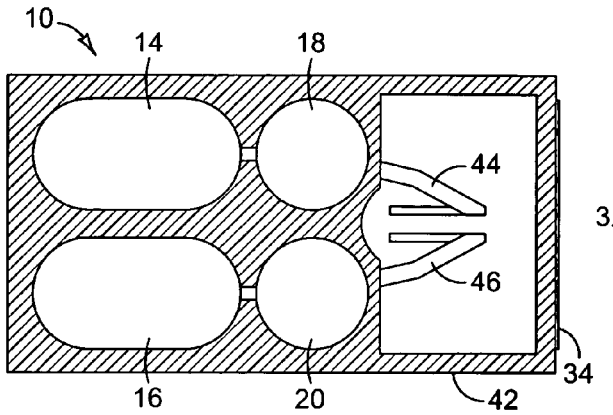
FIGS. 2-4 are section views taken along the lines 2-2, 3-3 and 4-4 in FIG. 1 showing one embodiment of ink channeling in the cartridge.
Figure 1:
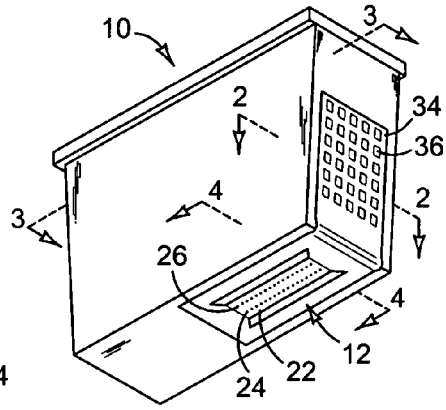
FIG. 1 is a perspective view illustrating one embodiment of an ink cartridge for an inkjet printer.
Figure 3:
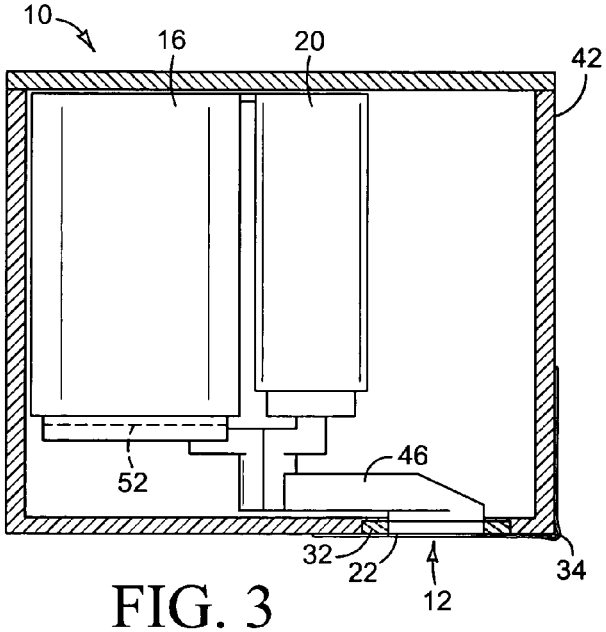
Figure 4:
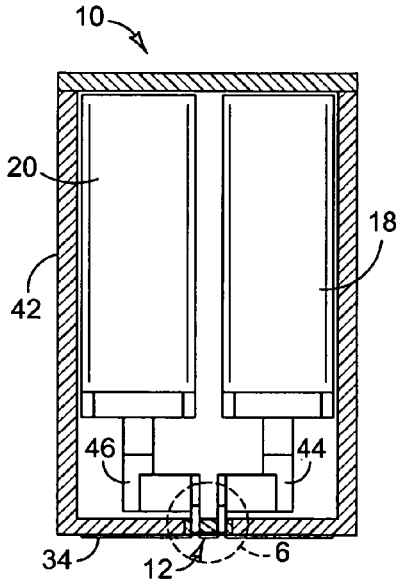
Figure 5:
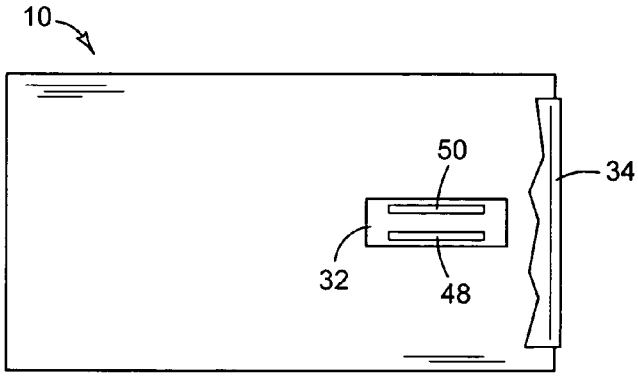
FIG. 5 is a partial cut-away bottom plan view of the cartridge of FIG. 1 showing ink feed slots at the mouth of the ink channels above the nozzle plate.
Figure 6:
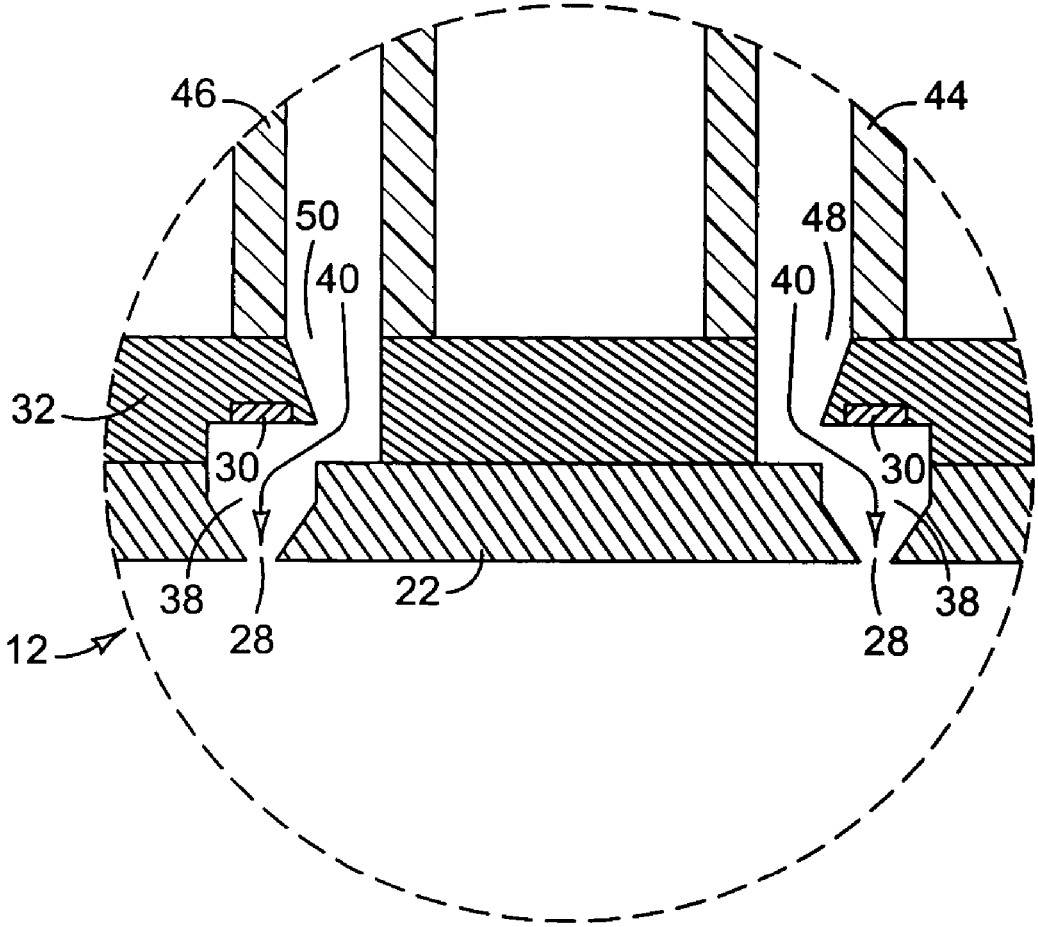
FIG. 6 is a detail view of a portion of the printhead in the cartridge of FIG. 4.

FIGS. 1-6 show an idealized representation of a print cartridge 10 for a thermal inkjet printer. FIG. 1 is a perspective view of cartridge 10. FIGS. 2, 3 and 4 are section views taken along the lines 2-2, 3-3 and 44 in FIG. 1. FIG. 5 is a bottom plan view and FIG. 6 is a detail section view of a portion of the printhead in cartridge 10. The relative scale and dimensions of some of the features of cartridge 10 have been greatly adjusted and some conventional features well known to those skilled in the art of inkjet printing have been omitted to better illustrate other more relevant features.

Referring to FIGS. 1-6, cartridge 10 includes a printhead 12 located at the bottom of cartridge 10 below ink chambers 14 and 16 and bubble chambers 18 and 20. Printhead 12 includes an orifice plate 22 with two arrays 24, 26 of ink ejection orifices 28. In the embodiment shown, each array 24, 26 is a single row of orifices 28. Firing resistors 30 formed on an integrated circuit chip 32 are positioned behind ink ejection orifices 28. A flexible circuit 34 carries electrical traces from external contact pads 36 to firing resistors 30.

When print cartridge 10 is installed in a printer, cartridge 10 is electrically connected to the printer controller through contact pads 36. In operation, the printer controller selectively energizes firing resistors 30 through the signal traces in flexible circuit 34. When a firing resistor 30 is energized, ink in a vaporization chamber 38 next to a resistor 30 is vaporized, ejecting a droplet of ink through orifice 28 on to the print media. The low pressure created by ejection of the ink droplet and cooling of chamber 38 then draws ink from an ink supply to refill vaporization chamber 38 in preparation for the next ejection. The flow of ink through printhead 12 is illustrated by arrows 40 in FIG. 6.

Referring now to the section views of FIGS. 2-4, ink is stored in ink chambers 14 and 16 formed within a cartridge housing 42. Each chamber 14 and 16 may be used to store a different color ink. Housing 42, which is typically formed from a plastic material, may be molded as a single unit, molded as two parts or constructed of any number of separate parts fastened to one another in the desired configuration. Referring now also to FIG. 5, a channel 44 leads from ink chamber 14 and bubble chamber 18 to an ink feed slot 48. A second channel 46 leads from ink chamber 16 and bubble chamber 20 to a second feed slot 50. Each feed slot 48, 50 is aligned with and positioned over an orifice array 24, 26. As described in detail below, ink passes from each ink chamber 14,16 through the corresponding channel 44, 46 to feed slot 48, 50 and printhead 12, where it is ejected through an orifice array 24, 26 as described above.

The two chamber cartridge 10 with a single printhead is just one example of a cartridge in which embodiments of the invention may be implemented. Other configurations are possible. For example, a print cartridge 10 might be a single color cartridge with only one ink chamber or a tri-color cartridge with three ink chambers. Cartridge 10 may be an integrated print cartridge that houses the printhead and the ink supply or a print cartridge that receives ink from a remote so-called "off axis" ink supply. Embodiments of the invention may be designed to allow for proper air management for multiple ink channels to access multiple ink feed slots within a small or otherwise restricted area.

Figure 9:
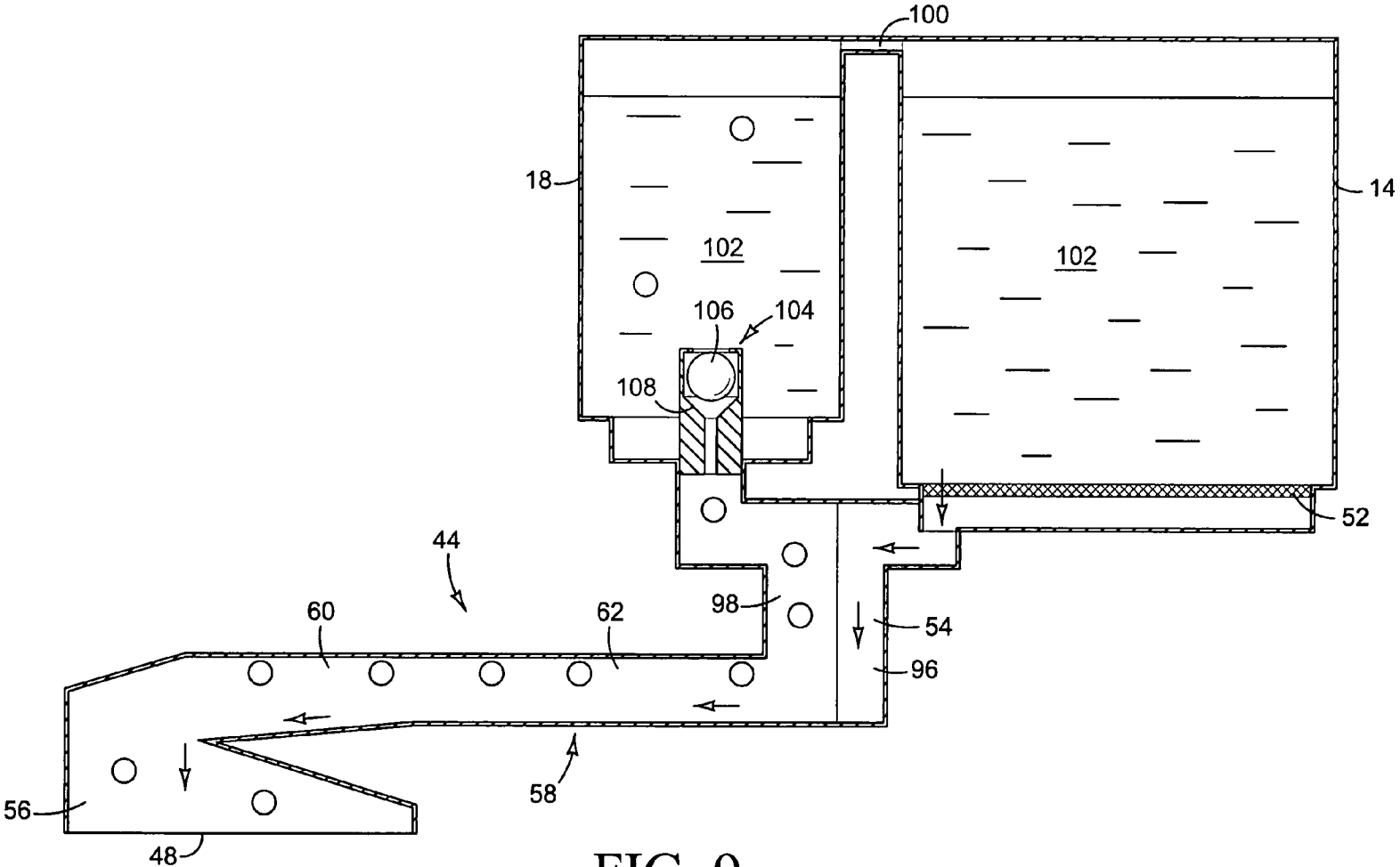
FIG. 9 is a section view of the ink chamber and flow channel shown in FIGS. 7 and 8.

Each channel 44, 46 is usually covered by a filter 52 at the bottom of the ink chambers 14 and 16 to keep contaminants, air bubbles and ink flow surges from entering printhead 12 through ink chambers 14 and 16. Ink flow and bubble movement through each channel 44, 46 will now be described with reference to FIGS. 7-19. FIGS. 7 and 8 are perspective views of one embodiment of an ink chamber and flow channel in the cartridge of FIG. 1. FIG. 9 is a section view of the ink chamber and flow channel shown in FIGS. 7 and 8. For convenience, the ink chamber, bubble chamber and channel shown in FIGS. 7-9 are designated ink chamber 14, bubble chamber 18 and channel 44 although the figures and accompanying description also apply to chambers 16 and 20 and channel 46. Ink flow in the figures is depicted by arrows and, in some figures, arrows accompanied by the word "ink." Bubbles in the figures are depicted by circles and, in some figures, circles accompanied by arrows. As used in this document, "upstream" and "downstream" are determined relative to fluid flow (ink flow in the figures), not bubble movement.

Referring to FIGS. 7-9, ink enters channel 44 from ink chamber 14 through filter 52 at an upper part 54 of channel 44 and ink leaves channel 44 at feed slot 48. Feed slot 48 is the mouth of a lower part 56 of channel 44. Ink moves generally vertically down through upper part 54, generally horizontally along a middle part 58 of channel 44 and then generally vertically again down through lower part 56 to feed slot 48. Air and other gases at printhead 12 (FIG. 6) that migrate into feed slot 48 form bubbles that grow in size until buoyancy forces move them up into channel 44. Bubbles move generally vertically up through lower part 56 of channel 44, horizontally along middle part 58 and then generally vertically up through upper part upper part 54 to bubble chamber 18. In the embodiment shown, middle part 58 of channel 44 includes a "taper tunnel" 60 and a "bubble tunnel" 62.

Figures 10, 11:
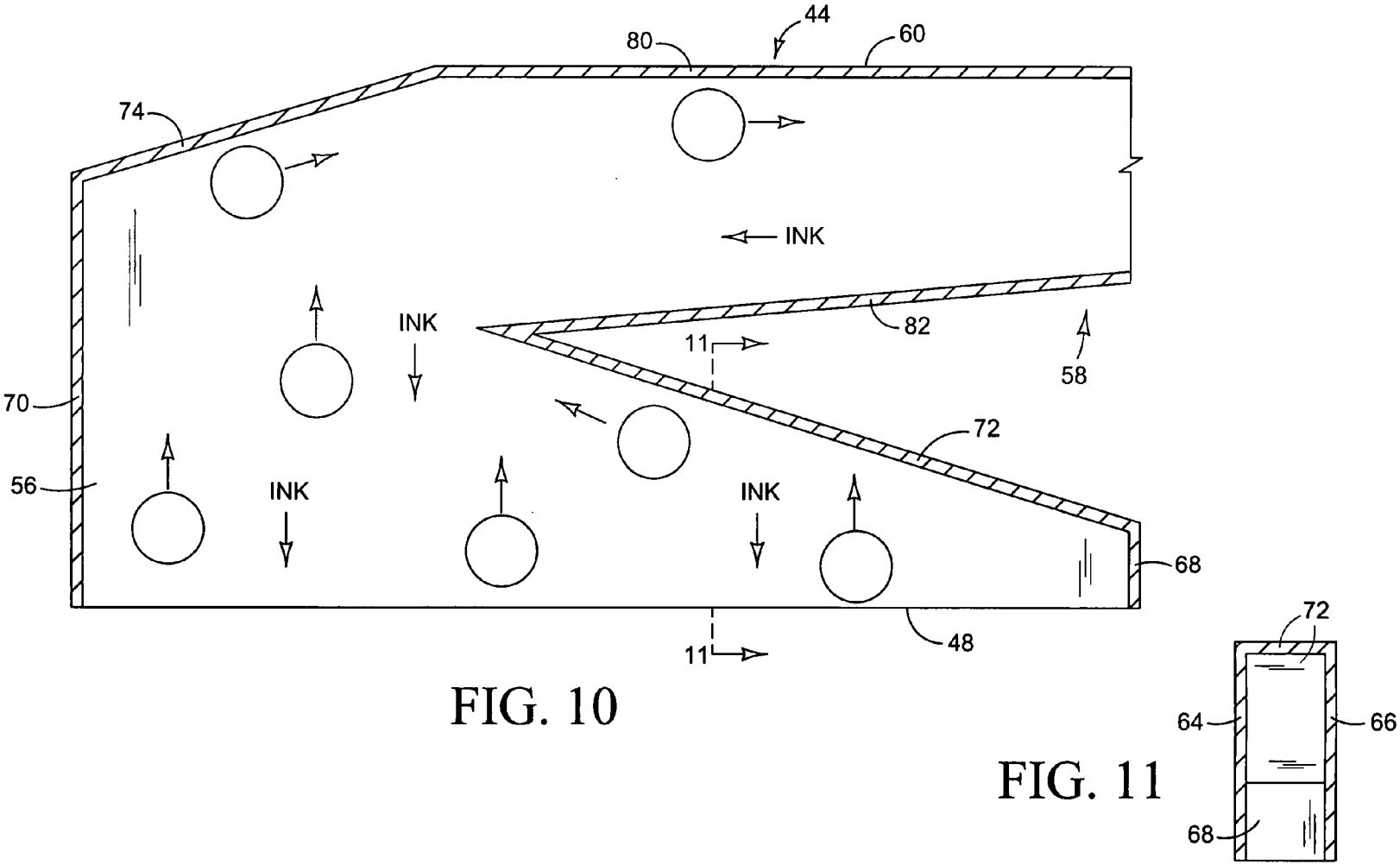
FIG. 10 is a section view taken along the line 10-10 in FIG. 7 showing the lower part the channel.
FIG. 11 is a section view taken along the line 11-11 in FIG. 10.

FIG. 10 is a section view taken along the line 10-10 in FIG. 7 showing in more detail lower part 56 of channel 44. FIG. 11 is a section view taken along the line 11-11 in FIG. 10. Referring to FIGS. 10 and 11, lower part 56 includes sidewalls 64 and 66 and endwalls 68 and 70. A first ceiling 72 extends between sidewalls 64 and 66 and slopes up away from endwall 68 until it meets the floor of taper tunnel 60 in middle part 58 of channel 44. A second ceiling 74 extends between sidewalls 64 and 66 and slopes up away from endwall 70 until it meets the ceiling of taper tunnel 60 in middle part 58. Sloped ceilings 72 and 74 help direct bubbles up through lower part 56 toward the middle part of the channel, which is taper tunnel 60 in FIG. 10.

Channel 44 expands from taper tunnel 60 to lower part 56 to slow the flow of ink toward feed slot 48 and help prevent dragging bubbles back down through feed slot 48 or blocking the ink path to feed slot 48. In the embodiment shown, sidewalls 64 and 66 are parallel to one another, as are endwalls 68 and 70. Other configurations are possible. For example, in may be desirable in some applications or environments for sidewalls 64 and 66 to taper out from top to bottom, or for endwalls 68 and 70 to taper out from one another, or both, to help move bubbles up through lower part 56 and slow the flow of ink through lower part 56 (by further increasing the cross sectional area of lower part 56 in the downstream direction). Cylindrical cross sections should be avoided in channel 44 in favor of corners and smaller channels to allow ink and bubbles to pass one another.

Buoyancy forces responsible for moving the air bubbles upward can be represented by the following buoyancy force equation 1:

$$F_b=4/3\pi r^3(\Delta p)g \tag{1}$$

where r is the radius of the bubble, (Δp) is the difference between the ink density and the air density, and g is the gravity constant. When the printhead is idle, any bubbles that have accumulated at feed slot 48 will be able to move up through lower part 56. In some conventional channels, in which the lower part of the channel is cylindrical, larger spherical bubbles can block the channel and impede ink flow to the printhead.

FIG. 12 is a section view taken along the line 12-12 in FIG. 7 showing in more detail taper tunnel 60 in the middle part 58 of channel 44. FIGS. 13 and 14 are section views taken along the lines 13-13 and 14-14 in FIG. 12. Referring to FIGS. 12-14, taper tunnel 60 is configured to move bubbles generally horizontally away from the lower feed slot area on toward bubble chamber 18. If there is room in the cartridge to ramp channel 44, then a sloped ceiling can be used in middle part 58 to allow buoyancy forces to continue moving bubbles horizontally toward bubble chamber 18. If, however, the channel itself must run horizontally, then buoyancy forces cannot be used to advance bubbles up the channel. Accordingly, taper tunnel 60 is configured to utilize surface tension forces in the bubbles to continue to move bubbles along channel 44. As best seen in FIG. 14, sidewalls 76 and 78 of taper tunnel 60 taper out from one another in the upstream direction. Surface tension forces at the gas/ink interface in unattached bubbles make the bubble tend to form a sphere, which has the smallest possible gas/ink interface. If a bubble is constrained between non-parallel walls 76 and 78 in channel 44, the bubble menisci will not have the same radius of curvature and the bubble will move toward a less confined position in the tunnel to equalize all radii of curvature.

A ceiling 80 extending between sidewalls 76 and 78 forms the top of taper tunnel 60 and a floor 82 extending between sidewalls 76 and 78 forms the bottom of taper tunnel 60. As best seen in FIGS. 12 and 14, floor 82 may be sloped from a low point where taper tunnel 60 is narrow (at the downstream end) to a high point where taper tunnel 60 is wide (at the upstream end). A sloped floor can be used to maintain a constant cross sectional area in taper tunnel 60 so that ink does not accelerate as it flows through taper tunnel 60, helping prevent bubbles from being swept back downstream. Walls 76 and 78, and ceiling 80 and floor 82, may be formed from or coated with a hydrophilic (to ink in this example) material to help prevent bubbles from dewetting the wall, which would make them more difficult to move.

If a bubble is sandwiched between parallel walls, the bubble will not be moved by its capillary forces. The bubble may move due to fluid flow or buoyancy forces. The contact (wetting) angle of the menisci and the taper angle of the structure determine the forces exerted by the meniscus on the bubble. For a non-tapered capillary tube, shown in FIG. 20, the Young-Laplace equation gives the pressure differential for each meniscus on either side of a bubble at equilibrium $$\Delta P=2\sigma/R \tag{2}$$

where σ is the surface tension and R is the radius of curvature of the bubble section. Since each mensicus has the same ΔP, the capillary forces balance and the bubble is not pressured to move by any capillary forces. For a tapered capillary tube, shown in FIG. 21, the pressure differential is different for each mensicus $$P_{c1}=2\sigma\cos(\theta+\Phi)/r_1 \tag{3}$$

$$P_{c2}=2\sigma\cos(\theta-\Phi)/r_2 \tag{4}$$

where Φ is the taper angle and r is the tube radius at the intersection of the meniscus and the wall. This "plus" Φ equation applies to the meniscus with the smaller radius ($r_1$ in FIG. 21). When $\cos(\theta-\Phi)/r_2=\cos(\theta+\Phi)/r_1$, the bubble is in equilibrium because the radius of curvature R of each meniscus is the same and the menisci form part of the same sphere.

Capillary forces may push a bubble in either direction to reach equilibrium. If a bubble in equilibrium increases in volume, mensicus forces chance, pushing the bubble to a larger area to achieve equilibrium. In the case where the wall is fully wetted, θ is zero and the relative capillary forces are a function of the radius of the tube at that point. The smaller radius meniscus pushes the larger radius meniscus "backward" until equilibrium is reached.

FIG. 15 is a section view taken along the line 15-15 in FIG. 7 showing in more detail bubble tunnel 62 in middle part 58 of channel 44. FIGS. 16 and 17 are section views taken along the lines 16-16 and 17-17 in FIG. 15. FIG. 18 is section view taken along the line 18-18 in FIG. 8 illustrating the upstream portion of bubble tunnel 62 where bubbles escape to the upper part of the channel 44. Referring to FIGS. 15-18, bubble tunnel 62 is configured to allow bubbles to accumulate in horizontal stretches of channel 44 while ink flows past the bubbles. If the design of channel 44 prevents the use of a taper tunnel configuration for all horizontal stretches of channel 44, such as taper tunnel 60 described above, then bubble tunnel 62 may be used as an alternative to a taper tunnel.

In the embodiment shown in FIGS. 15-18, sidewalls 84 and 86 of bubble tunnel 62 taper in towards one another moving down across the height of channel 44. As best seen in FIG. 16, the vertical cross section of bubble tunnel 62 includes a wider top region 88 to hold bubbles and a narrower bottom region 90 where ink can flow past the bubbles. A ceiling 92 extending between sidewalls 84 and 86 forms the top of bubble tunnel 62 and a floor 94 extending between sidewalls 84 and 86 forms the bottom of bubble tunnel 62. Once top region 88 is full of bubbles, then more bubbles coming in to the downstream end of bubble tunnel 62 push bubbles out of the upstream end of bubble tunnel 62, as shown in FIG. 18. The narrowing sidewalls 84 and 86 prevent bubbles from getting into bottom region 90.

The dimensions of channel 44 at bubble tunnel 62 needed to allow bubbles to accumulate while ink flows past. Whether or not these bubbles are pulled down when they meet wall 70 can be predicted by analyzing forces acting on the bubbles. The configuration of taper tunnel 60 and bubble tunnel 62 should provide sufficient cross sectional area to keep the buoyancy force of a bubble ($F_b$ from Equation 1 above) greater than the flow drag force $F_d$ and pressure drop force $F_{pd}$. Drag forces on a bubble may be approximated using Stokes law for a sphere floating up through a fluid, according to equation 5:

$$F_d = 6\pi r \mu v \quad (5)$$

where r is the radius of the bubble, μ is the viscosity of the fluid, and v is the velocity of the fluid in the channel. As the fluid velocity increases, the drag force will increase until it overcomes the buoyancy force and begins to drag the bubble down the channel. For longer channels, the pressure drop from friction of a fluid flowing through a tube may also be a factor.

The determination of bubble movement in vertical sections 54 and 56 involves balancing buoyancy forces $F_b$ and the drag forces $F_d$. If the bubble buoyancy force is greater than the drag forces $F_d$, then the bubble will not be dragged downstream by the flowing fluid.

$$F_b > F_d \quad (6)$$

The increase in drag forces due to an increase in the velocity of fluid flow may be represented by equation 7:

$$v = Q/A \quad (7)$$

where Q is the velocity of fluid flow and A is the cross sectional area of the channel. Analysis of bubble movement in areas of sloped ceilings 72 and 74 would be a function of the cosine of the ceiling slope and the buoyancy force.

FIG. 19 is a section view taken along the line 19-19 in FIG. 8 illustrating upper part 54 of channel 44. As best seen in FIG. 9, upper part 54 connects ink and bubble chambers 14 and 18 with middle part 58 of channel 44. Referring to FIGS. 9,18 and 19, upper part 54 is configured to allow ink to flow into channel 44 from ink chamber 14 while directing all bubbles up into bubble chamber 18. In the embodiment shown, upper part 54 has an old fashioned key hole shaped cross section that includes a narrow region 96 for ink flow and a wide region 98. Bubbles will not fit into narrow region 96, at least not easily, while they will move easily through wide region 98. A key hole configuration for upper part 54 provides an open ink channel away from the bubble path. Other such configurations are possible. Cylinders with ribs or V grooves, for example, may also provide the desired flow path for the bubbles and the ink.

Referring to FIG. 9, a transfer tunnel 100 connects bubble chamber 18 to ink chamber 14. Transfer tunnel 100 is positioned above the highest level of ink 102 in chambers 14 and 18. Consequently, air and other gases that escape from bubbles reaching the top of the ink in bubble chamber 18 join the air space normally maintained in the print cartridge, where they are warehoused or vented or pumped from the cartridge along with any other air or other gases that have accumulated in the cartridge. A porous membrane or other suitable filter (not shown) may be used in transfer tunnel 100 to prevent unfiltered ink in ink chamber 14 from entering channel 44 through bubble chamber 18.

As the flow of ink from ink chamber 14 to printhead 12 (FIGS. 1 and 6) increases, during higher rates of printing for example, the pressure drop across filter 52 also increases. The pressure drop across filter 52 tends to draw air into bubble chamber 18 and down into channel 44. A check valve 104 at the bottom of bubble chamber 18 prevents air in chamber 18 from moving down into channel 44. Check valve 104 includes a ball 106 and a beveled seat 108. In the embodiment shown, ball 106 has a lower density than the ink so that it floats above seat 108 when there is ink 102 in bubble chamber 18, allowing bubbles to move up into bubble chamber 18. A pressure drop across filter 52 will lower the ink level in bubble chamber 18 until ball 106 is seated in seat 108. An ink meniscus will form at the interface of ball 106 and seat 108, sealing channel 44 from the air in bubble chamber 18.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A fluid flow channel, comprising:

a first run for generally vertical fluid flow, the first run having a non-circular cross section characterized by a first smaller part into which substantially all bubbles in the ink cannot enter and a second larger part through which substantially all bubbles may enter and pass;

a second run for generally horizontal fluid flow, the second run connected to and positioned downstream from the first run such that fluid can flow from the first run to the second run, the second run having opposing sidewalls, a floor extending between the sidewalls, and a ceiling extending between the sidewalls, the ceiling sloping upward in an upstream direction or the sidewalls tapering in toward one another in a downstream direction, or both; and a third run for generally vertical fluid flow, the third run connected to and positioned downstream from the second run such that fluid can flow from the second run to the third run, the third run having opposing sidewalls and a ceiling extending between the sidewalls, the ceiling sloping upward in an upstream direction.

2. A print cartridge, comprising:

a first chamber for holding a printer marking material fluid;

a second chamber;

a printhead; and a channel extending between the first and second chambers and the printhead, the channel including a first run for generally vertical fluid flow, the first run connected to a fluid outlet from the first chamber and to a bubble inlet to the second chamber and the first run having a non-circular cross section characterized by a first smaller part into which substantially all bubbles in the ink cannot enter and a second larger part through which substantially all bubbles may enter and pass;

a second run for generally horizontal fluid flow, the second run connected to and positioned downstream from the first run such that fluid can flow from the first run to the second run, the second run having opposing sidewalls, a floor extending between the sidewalls, and a ceiling extending between the sidewalls, the ceiling sloping upward in an upstream direction or the sidewalls tapering in toward one another in a downstream direction, or both; and a third run for generally vertical fluid flow down into the printhead, the third run connected to and positioned downstream from the second run such that fluid can flow from the second run to the third run, the third run having opposing sidewalls and a ceiling extending between the sidewalls, the ceiling sloping upward in an upstream direction.

3. The cartridge of claim 2, further comprising a check valve positioned at the bubble inlet to the second chamber, the check valve configured to prevent air from entering the channel through the second chamber.

4. The cartridge of claim 3, wherein the check valve comprises a ball floatable in the fluid and a seat conforming to a perimeter of the ball.

5. The cartridge of claim 2, further comprising a filter positioned between the channel and the first chamber such that fluid flowing from the first chamber into the channel passes through the filter.

6. The cartridge of claim 3, wherein the first chamber and the second chamber are open to a common space.

7. The cartridge of claim 3, wherein the first chamber and the second chamber are connected to one another at a location away from the channel above a maximum level of fluid in each chamber.

8. The cartridge of claim 3, wherein the second run has a first cross sectional area and the third run has a second cross sectional area greater than the first cross sectional area such that fluid slows as it flows from the second run into the third run.

* * * * *

UNITED STATES PATENT AND TRADEMARK OFFICE

CERTIFICATE OF CORRECTION

PATENT NO. : 7,419,253 B2
APPLICATION NO. : 11/062223
DATED : September 2, 2008
INVENTOR(S) : David N. Olsen et al.

It is certified that error appears in the above-identified patent and that said Letters Patent is hereby corrected as shown below:

In column 2, line 4, delete “44” and insert -- 4-4 --, therefor.

Signed and Sealed this

Sixteenth Day of December, 2008

JON W. DUDAS
*Director of the United States Patent and Trademark Office*